US007914263B2

(12) United States Patent
Berger et al.

(10) Patent No.: US 7,914,263 B2
(45) Date of Patent: Mar. 29, 2011

(54) EJECTOR-TYPE ROTARY DEVICE

(76) Inventors: Vladimir Berger, Hayward, CA (US); Sergey Sapronov, San Mateo, CA (US)

( * ) Notice: Subject to any disclaimer, the term of this patent is extended or adjusted under 35 U.S.C. 154(b) by 823 days.

(21) Appl. No.: 11/803,186

(22) Filed: May 14, 2007

(65) Prior Publication Data

US 2008/0286121 A1 Nov. 20, 2008

(51) Int. Cl.
*F04F 99/00* (2009.01)

(52) U.S. Cl. ..... 417/67

(58) Field of Classification Search ..... 417/66, 417/67; 415/211.2; 55/515, 516
See application file for complete search history.

(56) References Cited

U.S. PATENT DOCUMENTS

| | | | | | |
|---|---|---|---|---|---|
| 1,951,956 | A * | 3/1934 | Wood | 55/508 |
| 2,047,634 | A * | 7/1936 | Jacobs | 55/492 |
| 2,114,884 | A * | 4/1938 | Landerholm | 417/67 |
| 2,911,137 | A * | 11/1959 | Edwards | 417/67 |
| 3,260,214 | A * | 7/1966 | Goettl et al. | 415/121.2 |
| 3,612,723 | A * | 10/1971 | van Staveren | 417/67 |
| 3,836,001 | A * | 9/1974 | Heldreth | 210/167.01 |
| 5,123,811 | A * | 6/1992 | Kuroiwa | 415/207 |
| 6,120,253 | A * | 9/2000 | Graves | 417/68 |
| 6,334,758 | B1 | 1/2002 | Popov | |
| 6,348,086 | B1 * | 2/2002 | Harms et al. | 96/125 |
| 6,394,760 | B1 | 5/2002 | Tell | |
| 6,619,927 | B1 | 9/2003 | Becker et al. | |
| 2008/0008409 | A1 * | 1/2008 | Hong et al. | 384/130 |

FOREIGN PATENT DOCUMENTS

| | | |
|---|---|---|
| EP | 1379670 | 1/2004 |
| RU | 2216651 | 11/2003 |
| RU | 2247873 | 3/2005 |

* cited by examiner

*Primary Examiner* — Devon C Kramer
*Assistant Examiner* — Dnyanesh Kasture

(57) ABSTRACT

A centrifugal-type ejector machine of the invention comprises a sealed housing with a rotating rotor. The interior of the housing is filled with a liquid. The rotor has a central axial opening and is provided with a plurality of radial channels leading to the outer periphery of the rotor in a substantially tangential direction to the rotor periphery. The device operates as a compressor or a vacuum chamber based on the principle that difference of speeds between the periphery of the rotating rotor and stationary liquid created a negative pressure at the exit of radial channels of the rotor connected to the source of gas, which is extracted from the channels of the rotor into liquid and is removed through the outlet port of the compression chamber. In case the device works as a vacuum chamber, evacuation occurs through the aforementioned radial channels and the hollow shaft of the rotor.

21 Claims, 5 Drawing Sheets

EJECTOR-TYPE ROTARY DEVICE

FIELD OF INVENTION

The present invention relates to a fluid-operated ejector type rotary machine, and more particularly, to a machine of the aforementioned type that consists of a compression section and a vacuum section. More specifically, the invention relates to a combined compressor/vacuum pump device that may operate either as a fluid compressor or as a fluid pump. In particular, although the invention is applicable to both liquids and gases, it is more advantageous to use the ejector-type rotary device as a gas compressor, or a gas pump.

BACKGROUND OF THE INVENTION

A jet ejector pump can be defined as a suction pump in which fluid under high pressure is forced through a nozzle into an abruptly larger tube where a high-velocity jet, at a low pressure in accordance with the Bernoulli law, entrains gas or liquid from a side tube opening just beyond the end of the nozzle to create suction.

Known in the art are ejector pumps of different types.

For example, U.S. Pat. No. 6,619,927 issued in 2003 to D. Becker, et al. describes an ejector pump provided in a fuel tank of a motor vehicle, which has a nozzle produced integrally with a mixing tube. The mixing tube is shaped in the form of a tubular cylinder, so that virtually the entire ejector pump may be produced from plastic in a mold allowing axial demolding. The nozzle is therefore aligned, exactly with respect to the mixing tube. The ejector pump consequently has a particularly high efficiency.

U.S. Pat. No. 6,394,760 issued in 2002 to P. Tell relates to a vacuum ejector pump. The ejector includes two or more nozzles arranged in series. A stream of air fed at high velocity through the nozzle is used to create a negative pressure in an outer, surrounding space. The surrounding space is in flow communication with at least one slot located between the nozzles. The nozzles are coupled together and assembled into an integrated nozzle body having at least one flexible valve member integrally arranged within the nozzle body to cover the flow communication with the surrounding space upon reaching a certain, desired pressure difference between the surrounding space and the atmosphere.

Russian Patent No. 2,247,873 issued in 2005 to A. Havkin, et al. relates to an ejector pump for delivery of various composite fluids to oil wells. The device comprises a housing, a union pipe connected to the housing which is used for the supply of the ejecting fluid, a union pipe for the fluid to be ejected, and a sleeve one part of the inner surface of which forms, in combination with the outer surface of the union pipe of the ejected fluid, an annular nozzle. This nozzle is connected to the pipe union of the ejecting fluid. The remaining part of the inner free annular space forms a mixing chamber, diffuser connected to the aforementioned chamber, and a pipe for discharge of the aforementioned mixture.

US Patent Application Publication No. 2005-2729 published in 2005 (inventor: S. Morishima) discloses an ejector pump which works to use dynamic energy of a jet of a main fluid emitted from a nozzle to suck a sub-fluid therein. When it is required to stop the ejector pump, the needle is moved to bring a sealing surface formed on a head thereof into abutment with a sealing surface formed around a main fluid flow path extending inside the ejector pump to close the main fluid flow path, thereby inhibiting the fluid pressure from acting on any downstream device. Upon the abutment, the needle is kept away from a nozzle, thereby avoiding undesirable wear or deformation of the needle and nozzle.

European Patent No. EP1378670 issued in 2004 to U. Engels describes a suction jet pump, which has an overflow beaker under its mixing tube. The mixing tube, complete with the diffuser on its outflow end, comes out into the beaker, which encloses it but is spaced out from it. It has an overflow aperture, which is fitted above the outflow end of the diffuser in the direction of flow.

Russian Patent No. RU2216651 issued in 2003 to S. Tsegel describes an installation for compression and delivery of different gaseous media to consumers. Proposed installation contains a pump, a separator and a liquid-gas jet apparatus. The pump is connected by its delivery side to an inlet of liquid into the liquid-gas jet apparatus, and by its suction side to the outlet of liquid medium from the separator. The liquid-gas jet apparatus is connected by gas inlet to a compressed gas source and by the gas-liquid mixture outlet to the separator. A branch pipe made on the housing of the separator in its upper part serves to let out compressed gas. Housing of the separator is partially filled with liquid medium. The separator is furnished with a drain chute, a set of phase separating nozzles and a louver pack. The drain chute is located along the separator housing. An inlet of the gas-liquid mixture in the separator from the liquid-gas jet apparatus is made over the inlet section of the drain chute. A set of phase separating nozzles is installed at the outlet of the drain chute, not higher that its outlet section. The louver pack is installed under the drain chute between the outlet of liquid medium from the separator and the set of phase-separating nozzles.

However, the ejector pumps described in the above references are designed for specific purposes, and none of them can be used as a universal pumping or suction machine for application in fields of industry for which it is not specifically designated.

It is known that existing centrifugal ejector pumps are characterized by simplicity of construction, high reliability of operation, (almost on the same level as that of a centrifugal pump that provides continuous supply of water to an ejector nozzle), and the highest volumetric/mass output capacity. However, the aforementioned existing centrifugal ejector pumps have low efficiency of energy use and are characterized by a limited field of applications (e.g., for evacuation and maintaining a reduced pressure in closed volumes).

A schematic view of a typical fluid-jet ejector nozzle is shown in FIG. 1. In fact, the pump shown in FIG. 1 is a generalized version of the pumps described in the aforementioned patent publications of the prior art, except that in some of the previously described publications the fluid to be ejected is a liquid and in some is gas.

Such a fluid-jet pump, which as a whole is designated by reference numeral 20, has a centrifugal pump unit 22, which is driven into rotation by a motor 24 for sucking air from the surrounding atmosphere. The air is delivered along a pipeline 26 to a diffuser 28 that has a narrowed cross-section portion 30 as compared to the pipeline 26. Existence of the narrowed cross-section portion 30 provides a reduced pressure in the area of the diffuser 28. This effect is used for intake of a fluid from the space around the diffuser 28. In the embodiment illustrated in FIG. 1, the aforementioned space is shown as a closed vacuum chamber 32. The fluid that fills the vacuum chamber 32 is drawn into an outlet pipe 34. For higher efficiency, the entrance into the outlet pipe 34 also may have a narrowed-section portion 36. In fact, the space between the exit from the pipeline 26 and the entrance into the pipe 34 comprises the aforementioned diffuser 28. In the above example, the air sucked by the pipeline 26 is an ejecting fluid and the fluid taken by the outlet pipe 34 is an ejected fluid.

In principle, and more often, the ejecting fluid used in the centrifugal pumps of the installations of the type described above, is a liquid, e.g., water, while the ejected fluid may comprise either a liquid or a gas.

An additional disadvantage of the pumps of the aforementioned type is inability of using thereof for compression of gases.

Furthermore, It should be noted that in a conventional ejector-type rotary machine the main source of all the losses is associated with movement of the working medium (which in most cases is liquid or gas) which is used as a carrier of energy for accomplishing the required work.

OBJECTS AND SUMMARY OF THE INVENTION

It is an object of the present invention to provide a highly universal ejector vacuum pump/compressor machine for application in various fields of industry. It is another object to provide the aforementioned ejector vacuum pump/compressor machine, which is characterized by high efficiency. It is still another object to provide the aforementioned ejector vacuum pump/compressor machine wherein the ejector effect is accomplished with a relative movement between a moving device and a "stationary" working medium.

A centrifugal-type ejector machine of the invention comprises a sealed hollow substantially cylindrical housing that contains a rotor rotatingly supported in bearings of the housing and driven into rotation by an externally located motor. The interior of the housing is filled with an ejecting fluid, e.g., liquid, such as water that surrounds the rotor. The rotor has a longitudinal channel for passage of the fluid to be extracted such as gas. The longitudinal channel of the rotor may be a central axial opening of the rotor. Furthermore, the rotor is provided with a plurality of radial channels, which are connected on their inner sides with the aforementioned axial opening of the rotor, while outer ends of the radial channels exit to the outer periphery of the rotor in a substantially tangential direction to the aforementioned outer periphery surface. The space between the inner surface of the housing and the outer surface of the rotor is filled with fluid-movement-retarding means, which is permeable to both extracting and extracted fluids. This may be, e.g., a mass of entangled wires that form fluid-passing cells. The mass of the wires can be packed into a net-like cylindrical cage. The outer surface of the cage can be fixed to the inner surface of the housing, while the inner surface of the cage may be in slight contact with the outer surface of the rotor. The housing has an outlet port to the atmosphere or to the device or appliance, which uses the machine as a compressor or a pump. On the side opposite to the motor, the rotor shaft has a longitudinal channel, or channels, or is made hollow, and the aforementioned channel, or channels, or the interior of the hollow shaft is/are connected to the aforementioned opening of the rotor. The inlet end of the hollow shaft can be used directly as an intake opening for the fluid which is to be extracted, e.g., as an air intake for sucking air from the atmosphere. Alternatively, the inlet opening of the hollow shaft can be connected to a vacuum chamber from which gas that fills the chamber will be evacuated to the rotor through the axial opening. By manipulating with the valves connected to the compression tank and to the vacuum chamber, the machine of the invention can be selectively used as a compressor, pump or as a source of vacuum.

DETAILED DESCRIPTION OF THE DRAWINGS

Analysis of existing patents and prior-art technique conducted by the applicants showed that all ejector pumps known to them are based on the use of a moving working medium as an energy-carrier that flows around or flows into a certain stationary device that provides interaction between the material to be pumped out and a flow of the working medium that entraps fragments of the pumped-out material and carries it away with the flow thus providing suction of a new portion of the aforementioned material. However, applicants found out that the ejector effect can also be realized in a device where a relative movement exists between a moving device and a "stationary" working medium.

A construction of the proposed centrifugal-type ejector pump/compressor [hereinafter referred to generally as a "centrifugal-type ejector machine"] of the present invention possesses all the advantages of the ejector pump and at the same time eliminates or significantly reduces a major part of the losses that lead to decrease in the pump/compressor efficiency. The proposed centrifugal-type ejector machine may operate in the following modes:

evacuation of gas
compression of gas
evacuation and compression of gas;
pumping of liquid.

An example of a centrifugal-type ejector machine of the invention that may be used as a basis of a pump or a compressor operating on the principle of the combined centrifugal and ejector effects is described below with references to the attached drawings. Although the following examples describe the ejecting fluid as liquid and a fluid to be ejected as gas, it should be understand that such combination of fluids is given only as an example and that fluids of both types can be either liquids, or gases, or any combinations of liquid and gas.

Figure 1:
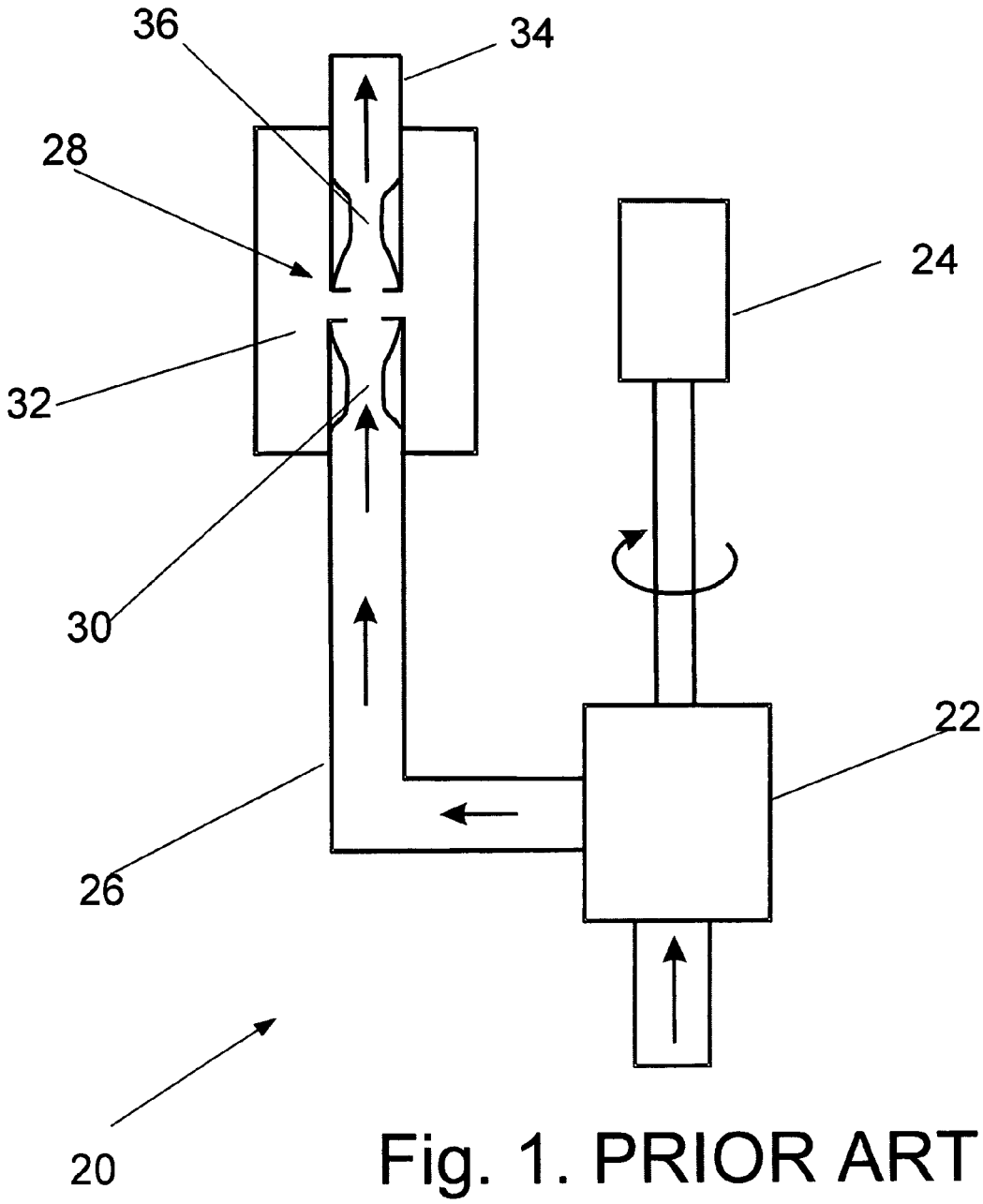
Fig. 1. PRIOR ART
FIG. 1 is a schematic longitudinal sectional view of the known centrifugal ejector pump.
Figure 2:
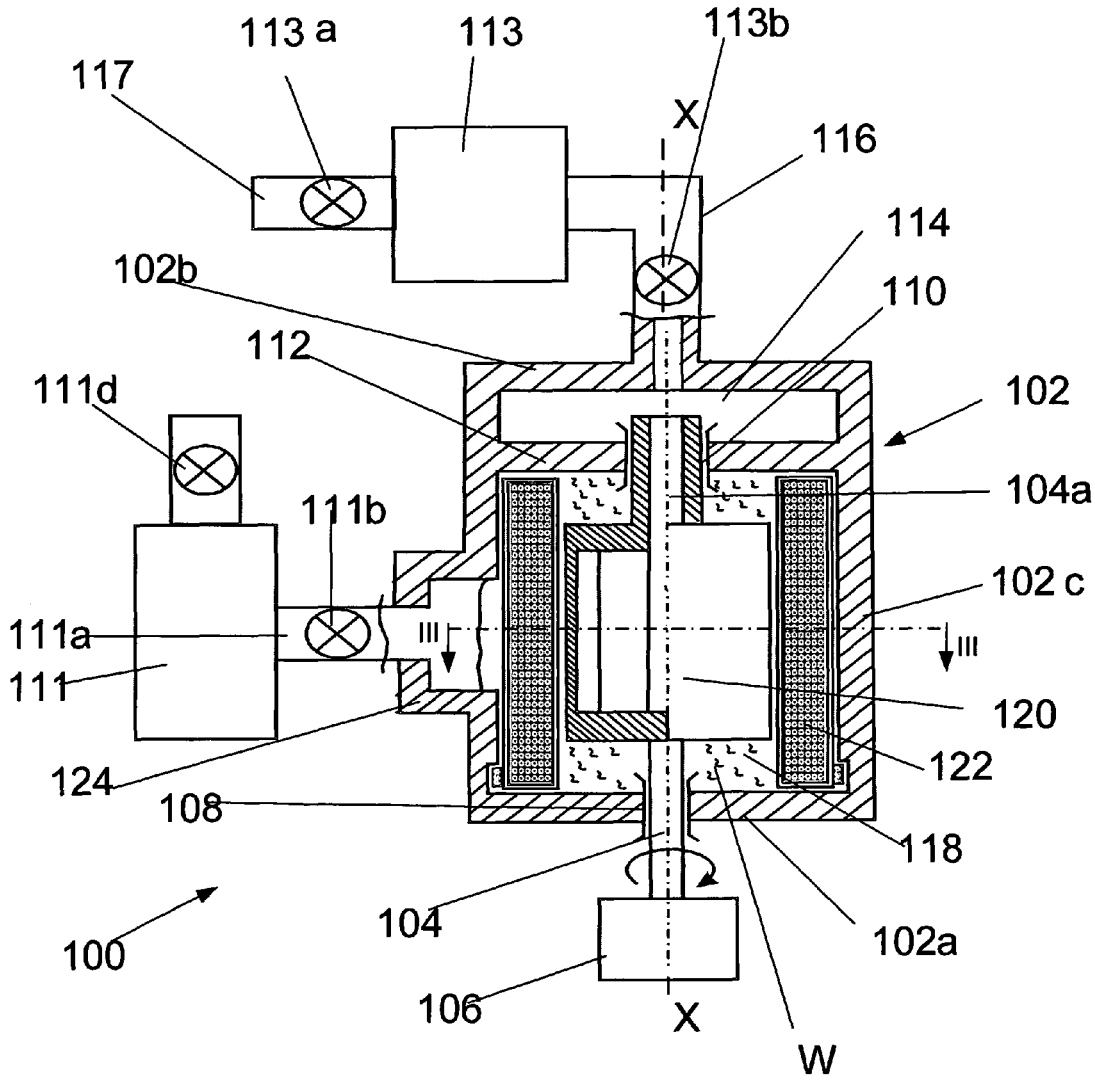
FIG. 2 is a schematic longitudinal sectional view of the centrifugal-type ejector machine of the invention.
Figure 3:
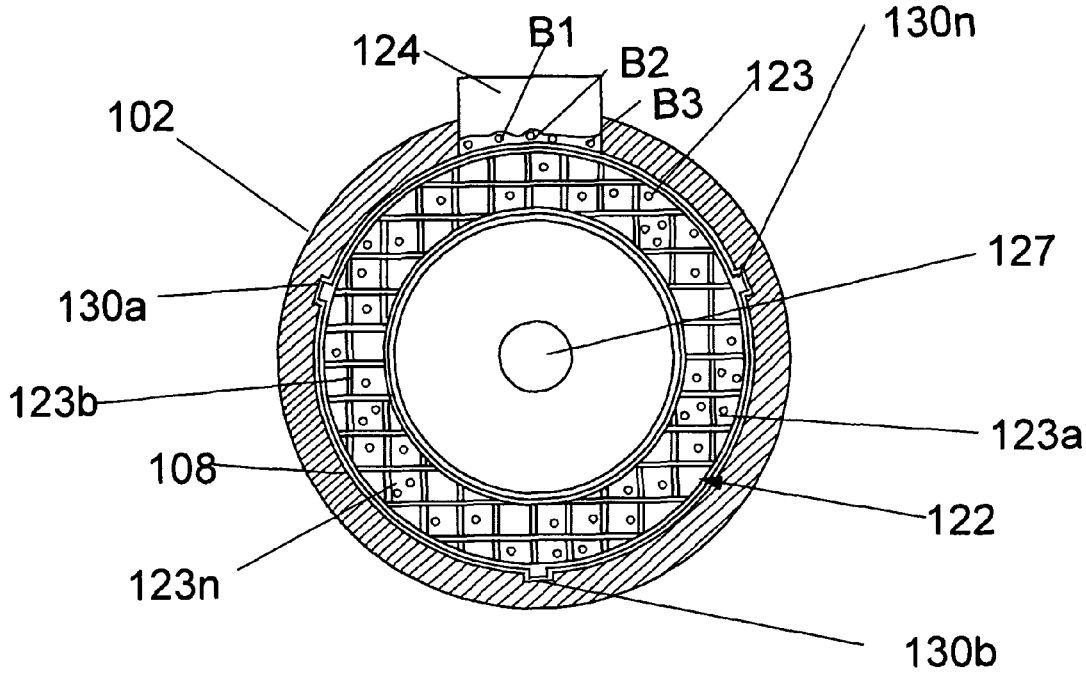
FIG. 3 is a cross-sectional view along line III-III of FIG. 2.

FIG. 2 is a schematic longitudinal sectional view of the universal centrifugal-type ejector machine according to one example of the invention. FIG. 3 is a cross-sectional view along line III-III of FIG. 2, and FIG. 4 is a partial cross-sectional view of the rotor.

As can be seen from the drawings, the ejector pump, which in general is designated by reference numeral 100, has a sealed hollow substantially cylindrical housing 102, which can be made, e.g., from metal, ceramic, or plastic. The cylindrical housing contains a rotary shaft 104 arranged in the direction of an axial axis X-X of the cylindrical housing 102. The rotary shaft is driven into rotation from a motor 106 located outside the housing 102 and is rotatingly supported in the housing 102 by bearings 108 and 110, of which bearing 108 is installed in a side wall 102*a* of the housing 102, and the bearing 110 is supported by a transverse partition 112 formed inside the housing 102 near the side wall 102*b* which is opposite to the side wall 102*a*. A space between the partition 112 and the sidewall 102*b* defines an intermediate chamber 114.

Connected to the sidewall 102*b* is a pump inlet pipe 116 that is used for the supply of a fluid medium to be ejected or pumped out, e.g., air, to the ejection pump 100. It can be seen that the ejected fluid is supplied to the pump through the aforementioned intermediate chamber 114. A space of the housing 102 between the sidewall 102*a*, transverse partition 112, and a cylindrical wall 102*c* of the pump housing 102 defines a working chamber 118 of the ejector pump 100.

Figure 4:
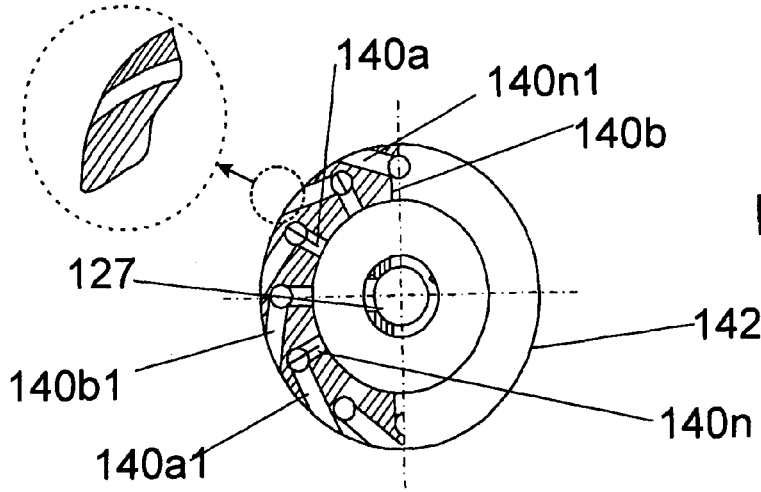
FIG. 4 is a partial cross-sectional view of the rotor.

As shown in FIGS. 2, 3, and 4, the rotary shaft 104 rigidly supports a rotor 120, a cylindrical shape, and a round cross section. The working chamber 118 is filled with means 122 for retarding movements of the extracting fluid. For example, if the working chamber is filled with water, the purpose of the fluid movement retarding means 122 is to prevent water from rotation together with the rotor 120. As can be seen from FIGS. 2 and 3, the rotor has a hollow interior 127 which is free of the fluid that fills the housing.

According to one example (FIG. 3), the means 122 for retarding movements of the extracting fluid may comprise a cylindrical cage with fine irregular cells 123*a*, 123*b*, . . . 123*n* for passing the flows of the fluid in an irregular mode from the interior of the working chamber to a pump outlet port 124. The cells may be filled with a mass of chaotically arranged entangled wires 123.

Figure 5:
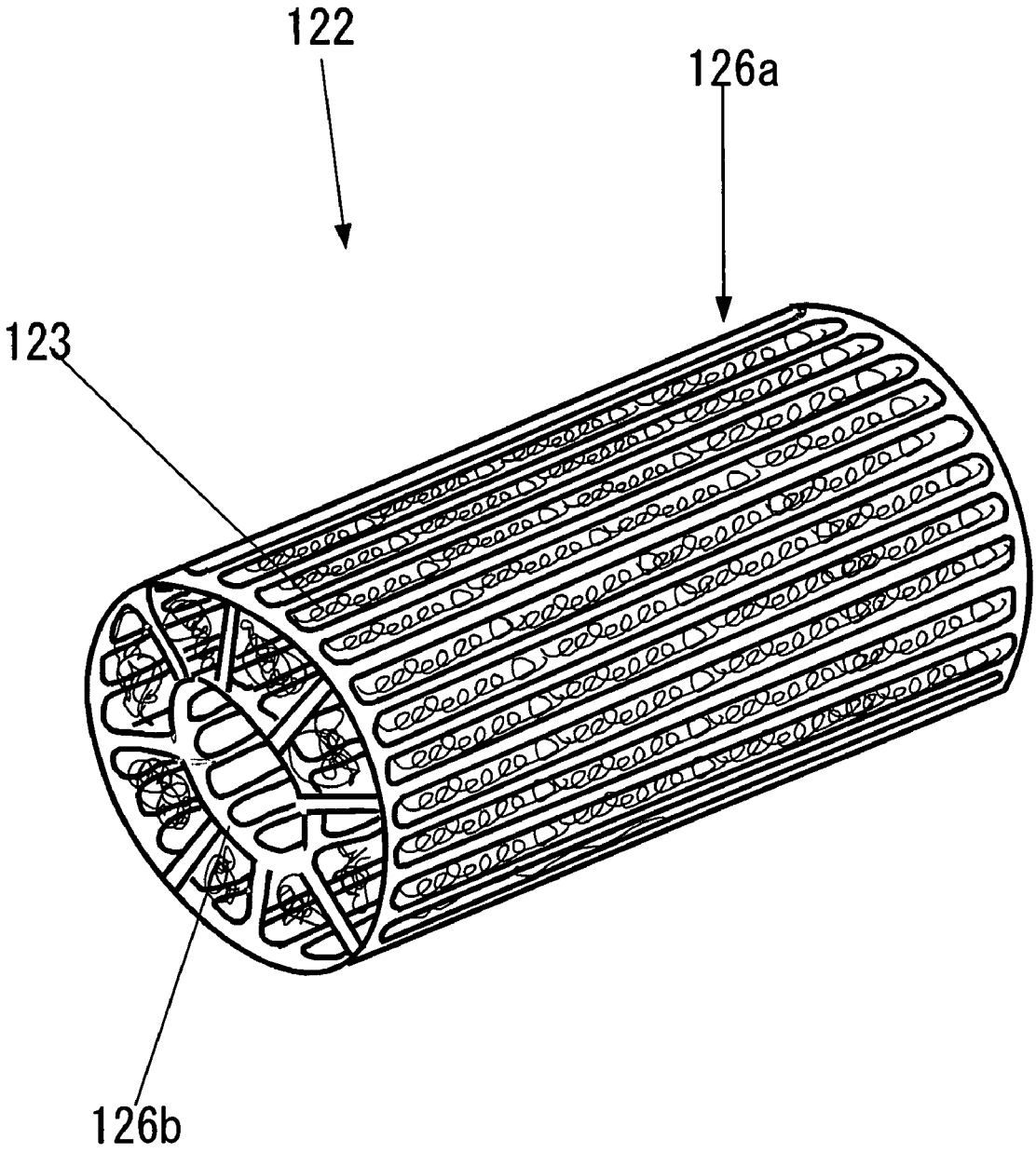
FIG. 5 is a three-dimensional view of the cage that contains the flow-regularity destructing mass.

A more specific example of the fluid movement retarding means 122 is shown in FIG. 5 which is a three-dimensional view of the means 122. This unit comprises a cage 126 formed by two coaxial cylindrical grids, i.e., an outer cylindrical grid 126*a* and an inner cylindrical grid 126*b*. The space between the outer cylindrical grid 126*a* and the inner cylindrical grid 126*b* is filled with the aforementioned mass formed by the entangled wires 123. The wires having a diameter, e.g., in the range of 0.1 to 1 mm, and in order not to create a noticeable resistance to the flow of the pumped out gas, or liquid, an average size of the cells formed between the wires may range from about 1 mm to 5 mm or more. It is understood that the above numbers are given merely as examples. The purpose of the fluid movement retarding means 122 is to prevent entrapment of the liquid by rotation of the rotor because of the forces of viscous friction.

In order to prevent rotation of the cage 126 together with the rotor 120 because of the aforementioned forces of viscous friction, the cage 126 is fixed in the cylindrical housing 102, e.g., by keys 130*a*, 130*b*, . . . 130*n* (FIG. 3). Appropriate key slots (not shown) for the keys 130*a*, 130*b*, . . . 130*n* should be provided on the inner surface of the cylindrical housing 102. The inner surface of the inner cylindrical grid 126*b* is maintained in a slight physical contact with the outer surface of the rotor 120. In the context of the present invention, the term "slight physical contact" means friction contact between the outer surface of the rotor 120 and the inner surface of the inner cylindrical grid that allows the rotor to have a sliding contact with the inner cylindrical grid.

Figure 6:
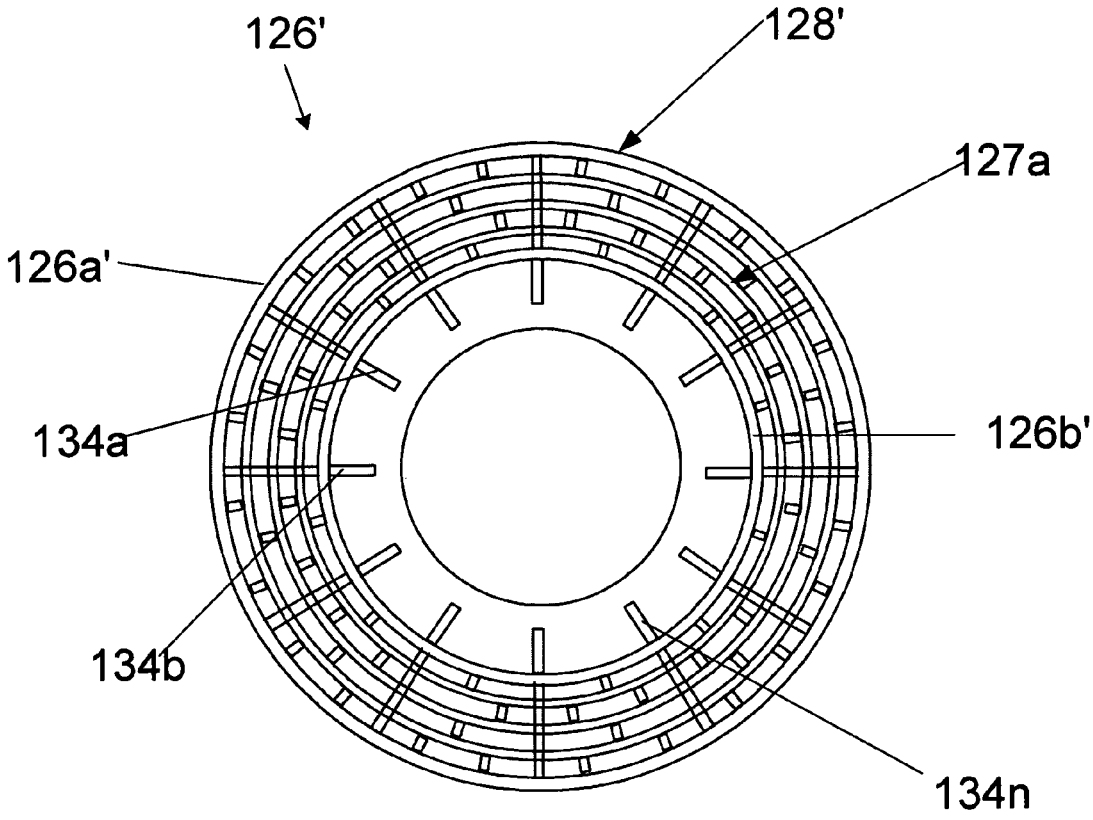
FIG. 6 is a cross-sectional view of the cage of FIG. 5 without the flow-regularity destructing mass.

FIG. 6 is a cross-sectional view of the cage of FIG. 5 made in accordance with an embodiment of the invention. The cage 128' comprises an outer cylindrical grid 126*a*', an inner cylindrical grid 126*b*', and a plurality of intermediate cylindrical grids 127*a* between them. The inner cylindrical grid 126*b*' is provided with radial longitudinal ribs 134*a*, 134*b*, . . . 134*n*. Other modifications are possible.

The rotor 120 is located on the shaft 104 in an intermediate position between the sidewall 102*a* and the transverse partition 112. As shown in FIG. 2, the shaft 104 has a longitudinal channel 104*a*, one end of which is open into the hollow interior 127 of the rotor 120 and the other end communicates with the intermediate chamber 114. As can be seen from FIG. 4, the cylindrical wall of the rotor 120 has a plurality of circumferentially spaced radial channels 140*a*, 140*b*, 140*c*, . . . . Near the outer surface or periphery 142 of the rotor 120, portions 140*a*1, 140*b*1, 140*n*1, . . . of the channels 140*a*, 140*b*, 140*c*, . . . change their orientation to directions substantially tangential to the rotor periphery 142 (FIG. 4) and terminate on the rotor periphery 142. Reference numeral 124 (FIGS. 2 and 3) designates an outlet port of the ejection pump 100.

In order to make the centrifugal-type ejector machine of the invention more versatile with possibility of using this machine selectively in a compression or in a vacuum-pump mode of operation, the machine can be provided with a compression tank 111 (FIG. 2). The compression tank 111 is connected with the pump outlet port 124 by a pipe 111*a* with a shut-off valve 111*b*. The compression tank 111 has an outlet pipe union 111*c* with a shut valve 111*d* for connection to a device or an appliance working from compressed gas, e.g., a pneumatic power tool, or the like (not shown in the drawings).

If necessary, the centrifugal-type ejector machine of the invention may be further provided with a vacuum chamber 113 (FIG. 2) that may be used as a source of vacuum or a reduced pressure, e.g., for removal of gases from a closed volume. The vacuum chamber is arranged on the gas-supply end of the machine and comprises a sealed container, which surrounds the pump inlet pipe 116. The vacuum chamber may be provided with a shut off valve 113*a* that is located in the outlet pipe 117 and can be switched to the OFF position, e.g., for disconnecting the vacuum chamber, in which the vacuum has been developed to a predetermined level, from the pump section. The valve 113*b* is needed to prevent penetration of water from the pump into the vacuum chamber 113 when the motor 106 is deenergized. (FIG. 2).

Operation

The centrifugal-type ejector machine 100 operates as follows. Let us first consider operation of the machine 100 in a compression mode. The motor 106 is activated and begins to rotate thus causing rotation of the rotor 120. The outer surface 142 of the rotating rotor 120 interacts with the working liquid W that fills the interior of the working chamber 118 (FIG. 2). The layer of the working liquid W that is in contact with this rotating outer surface 142 has a velocity much lower than the circumferential speed on the outer surface 142 of the rotor 120 (due to a dragging effect of the fluid movement retarding means 122 (FIGS. 2, 3, 5, and 6)) and, hence, at the outlets of the channel portions 140*a*1, 140*b*1, 1240*c*1, . . . formed in the rotor 120. Since the aforementioned channel portions 140*a*1, 140*b*1, 1240*c*1, . . . have directions which are close to the direction of tangents to the outer cylindrical surface 142 of the rotor 120 and since they are opposite to direction of rotation, it can be assumed that in the relative movement between the rotor 120 and the working medium W the latter flows around the profiles of the channel portions 140*a*1, 140*b*1, 1240*c*1, . . . in the area of their exit from the rotor 120 in a substantially tangential directions. In this relative movement, the working medium W entraps fragments (portions) of the evacuated fluid, e.g., gas and separates them from the gas that remains in the channels 140*a*, 140*b*, 140*c*, . . . . The layer of the working medium W with the entrapped gas is forced by centrifugal forces away from the rotating outer cylindrical surface 142 of the rotor 100 toward the inner walls of the device housing 102. Fragments of the gas thrown to the inner walls of the device housing 102 are converted into gas bubbles B1, B2, B3, . . . (FIG. 3). Since these gas bubbles have density, which is much lower than the density of the working medium W, the bubbles B1, B2, B3, . . . are quickly separated from the rotor outer surface 142. The separated gas bubbles rise to the compression tank 111 (FIG. 2), where the gas may be either compressed or released to the atmosphere.

If, in the embodiment of the machine 100 shown in FIG. 2, the valve 11*d* is closed and the valve 111*b* is opened, gas pressure in the compression tank 111 will grow to a predetermined value. For use as a gas compressor, the valve 111*b* is closed, and the valve 111*d* is opened for the supply of the compressed gas to the device or appliance (not shown) operating on compressed gas. Since the portions of the gas removed from the channels 140*a*, 140*b*, 140*c*, . . . through the interaction of the rotor surface 142 with the surrounding working medium W are compensated by new portions of gas that is supplied through the hollow interior 127 of the rotor 120, the gas evacuation process proceeds in a continuous manner (like in a conventional ejector pumps).

If necessary, the centrifugal-type ejector machine of the invention may be further provided with a vacuum chamber 113 (FIG. 2) that may be used as a source of vacuum or a reduced pressure, e.g., for removal of gases from a closed volume. The vacuum chamber is arranged on the gas-supply end of the machine and comprises a sealed container, which surrounds the pump inlet pipe 116. The vacuum chamber may be provided with a shut off valve 113*a* that is located in the outlet pipe 117 and can be switched to the OFF position, e.g., for disconnecting the vacuum chamber, in which the vacuum has been developed to a predetermined level, from the pump section. The valve 113*b* is needed to prevent penetration of water from the pump into the vacuum chamber 113 when the motor 106 is deenergized (FIG. 2) [AMENDMENT C].

Practical Example

Performance characteristics of the centrifugal-type ejector machine 100 of the invention were measured on a specific sample of the machine used by applicants as a test model. The test model had the following structural geometrical parameters:

Inner diameter of the housing: 100 mm

Outer diameter of the rotor: 75 mm

Rotary speed of the rotor: 30; 40, and 50 revolutions per second;

Working medium: water

Flow-regularity destructing means: packing in the form of a large-cell Nylon grid The following surplus pressures (relative to the surrounding atmospheric pressure) were obtained in the mode of compression of air taken from the atmosphere:

| Rotary speed (rev/sec) | Maximum pressure increase (mmHg) |
|---|---|
| 30 | 60 |
| 40 | 118 |
| 50 | 210 |

The following reduced pressures were obtained in the mode of evacuation of gas with release to the atmosphere:

| Rotary speed (rev/sec) | Maximum pressure decrease (mmHg) |
|---|---|
| 30 | 33 |
| 40 | 77 |
| 50 | 152 |

Scattering of measurement data (about 10%) that occurred in the test after each assembling/disassembling was caused by non-controllable position of the Nylon grid used for attenuation of the working-medium flow in the experimental device. However, performance parameters of the centrifugal-type ejector machine of the invention can be improved if the machine is manufactured with higher quality and accuracy that can be obtained in the commercial production.

Experiments were carried out for both horizontal and vertical orientation of the rotor and housing. In both cases the results were identical.

It can be assumed that the centrifugal-type ejector machine of the invention will have much higher efficiency than the conventional machine of this type since the device of the invention eliminates losses associated with high-speed movements of the liquid inside the centrifugal pump and in liquid-supply pipes and well as losses in connection with the release of the working liquid and energy stored therein.

Thus it has been shown that the present invention provides a highly universal ejector vacuum pump/compressor machine for application in various fields of industry, which is characterized by high efficiency and operates with a relative movement between a moving device and a "stationary" working medium.

Although the invention has been described with reference to specific examples and drawings, it is understood that these examples and drawings should not be construed as limiting the application of the invention and that any changes and modifications are possible without departure from the scope of the attached patent claims. As has been mentioned above, the extracted fluid is not necessarily gas, and the extracting fluid is not necessarily liquid, but both fluids may comprise any combination of gases and liquids. When both fluids are gases, the rotor should rotate with a very high speed. When the extracting fluid is liquid, it is not necessarily water and may comprise another liquid. The gas is not necessarily air and may comprise another gas. The cage with flow-regularity destructing means may be embodied in many other forms, e.g., may comprise a plurality of transversely arranged plates with a plurality of holes, etc. The rotor may have a cross-section not exactly cylindrical, e.g., it may have an elliptical or oval shape. The radial channels of the rotor may be used in different quantities with different arrangement patterns and with different cross-sections of the channels. The outlet ports of the aforementioned channels may have different profiles. The fluid movement retarding means may comprise a plurality of ribs attached to the inner walls of the housing and extending radially inward into the housing interior towards the rotor. The cage may be replaced just by the mass of entangled wires, and the longitudinal channel for the supply of the fluid to be extracted may be formed by a tube that concentrically embraces the shaft and forms an annular gap with the shaft for the supply of the fluid.

The invention claimed is:

1. An ejector-type rotary device comprising:

a sealed hollow housing that has an outlet port and an inner wall and is filled with a first fluid;

a rotor rotatingly installed in the aforementioned sealed hollow housing, said rotor having a hollow interior, an outer surface, and a plurality of radial channels that exit to the outer surface of the rotor and are connected to said hollow interior of the rotor, the hollow interior of the rotor being substantially free of the first fluid during operation of the device;

a drive means for rotating the rotor;

a shaft that supports said rotor in the sealed hollow housing, the shaft having a longitudinal channel, one end of said longitudinal channel of the shaft being open into said hollow interior of the rotor, and the other end of the longitudinal channel of the shaft being connected to a source of a second fluid which is to be extracted.

2. The ejector-type rotary device of claim 1, further provided with a fluid movement retarding means for retarding movement of the aforementioned first fluid during rotation of the rotor, said fluid movement retarding means being located in a space between the inner walls of the sealed hollow housing and the aforementioned outer surface of the rotor.

3. The ejector-type rotary device of claim 2, wherein the aforementioned fluid movement retarding means is attached to the inner wall of the sealed hollow housing.

4. The ejector-type rotary device of claim 3, wherein the aforementioned fluid movement retarding means comprises a cylindrical cage that has an outer surface, an inner surface, and a space between the inner surface and the outer surface of the cylindrical cage which is filled with a fluid flow retarding mass that forms cells permeable to the first fluid, said inner surface of the fluid movement retarding means allowing the rotor to have a sliding contact with the inner cylindrical grid.

5. The ejector-type rotary device of claim 4, wherein the flow retarding mass comprises a three-dimensional grid.

6. The ejector-type rotary device of claim 1, wherein the first fluid and the second fluid are selected from the group consisting of gas and liquid.

7. The ejector-type rotary device of claim 2, wherein the first fluid and the second fluid are selected from the group consisting of gas and liquid.

8. The ejector-type rotary device of claim 3, wherein the first fluid and the second fluid are selected from the group consisting of gas and liquid.

9. The ejector-type rotary device of claim 4, wherein the first fluid and the second fluid are selected from the group consisting of gas and liquid.

10. The ejector-type rotary device of claim 3, wherein the first fluid is liquid and the second fluid is gas.

11. The ejector-type rotary device of claim 10, further provided with a compression tank connected to the aforementioned outlet port of the sealed hollow housing.

12. The ejector-type rotary device of claim 2, further provided with a compression tank connected to the aforementioned outlet port of the sealed hollow housing.

13. The ejector-type rotary device of claim 10, further provided with a vacuum chamber connected to the longitudinal channel of the shaft.

14. The ejector-type rotary device of claim 11, further provided with a vacuum chamber connected to the longitudinal channel of the shaft.

15. The ejector-type rotary device of claim 6, wherein the radial channels of the rotor have channel portions that exit to the outer surface of the rotor, said channel portions exiting to the outer surface of the rotor in a direction substantially tangential to the aforementioned outer surface of the rotor.

16. The ejector-type rotary device of claim 7, wherein the radial channels of the rotor have channel portions that exit to the outer surface of the rotor, said channel portions exiting to the outer surface of the rotor in a direction substantially tangential to the aforementioned outer surface of the rotor.

17. The ejector-type rotary device of claim 8, wherein the radial channels of the rotor have channel portions that exit to the outer surface of the rotor, said channel portions exiting to the outer surface of the rotor in a direction substantially tangential to the aforementioned outer surface of the rotor.

18. The ejector-type rotary device of claim 9, wherein the radial channels of the rotor have channel portions that exit to the outer surface of the rotor, said channel portions exiting to the outer surface of the rotor in a direction substantially tangential to the aforementioned outer surface of the rotor.

19. The ejector-type rotary device of claim 10, wherein the radial channels of the rotor have channel portions that exit to the outer surface of the rotor, said channel portions exiting to the outer surface of the rotor in a direction substantially tangential to the aforementioned outer surface of the rotor.

20. The ejector-type rotary device of claim 11, wherein the radial channels of the rotor have channel portions that exit to the outer surface of the rotor, said channel portions exiting to the outer surface of the rotor in a direction substantially tangential to the aforementioned outer surface of the rotor.

21. The ejector-type rotary device of claim 12, wherein the radial channels of the rotor have channel portions that exit to the outer surface of the rotor, said channel portions exiting to the outer surface of the rotor in a direction substantially tangential to the aforementioned outer surface of the rotor.

* * * * *